United States Patent [19]

Goldbeck

[11] 4,271,768

[45] Jun. 9, 1981

[54] ASSEMBLY FOR FORMING PIPED-EDGE OPENINGS IN A FABRIC WORKPIECE

[75] Inventor: Heinz Goldbeck, Bielefeld, Fed. Rep. of Germany

[73] Assignee: Dürkoppwerke GmbH, Bielefeld, Fed. Rep. of Germany

[21] Appl. No.: 165,398

[22] Filed: Jul. 2, 1980

[30] Foreign Application Priority Data

Aug. 11, 1979 [DE] Fed. Rep. of Germany ..... 2932664

[51] Int. Cl.[3] ..... D05B 3/06

[52] U.S. Cl. ..... 112/68

[58] Field of Search ..... 112/68, 65, 67; 2/266

[56] References Cited

U.S. PATENT DOCUMENTS

| | | | |
|---|---|---|---|
| 2,529,072 | 11/1950 | Bradford et al. | 112/68 |
| 3,814,037 | 6/1974 | Nicolay | 112/68 |
| 3,820,481 | 6/1974 | Nicolay | 112/68 |
| 3,847,097 | 11/1974 | Dusch et al. | 112/68 |
| 4,075,954 | 2/1978 | Hintzen et al. | 112/68 |

*Primary Examiner*—H. Hampton Hunter

*Attorney, Agent, or Firm*—Karl F. Ross

[57] ABSTRACT

An assembly at a sewing machine for forming a piped-edge or bound pocket opening in a garment workpiece includes a pair of sewing needles for stitching two parallel seams in the workpiece and in a reinforcing strip laid thereon, a blade for cutting a slit in the fabric pieces between the two seams and a pair of cross-sectionally angular cutters removably clamped to the plunger of a pneumatic actuating cylinder and having vertices engaging opposite sides of a mandrel also mounted on the plunger. Upon charging of the cylinder, the mandrel passes through an end of the slit to widen same and consequently enable the traversing of the slit by one or the other of the angular cutters, whereby one cutter is effective to form a V-shaped incision in the fabric pieces at the slit end and the other cutter is ineffective.

4 Claims, 7 Drawing Figures

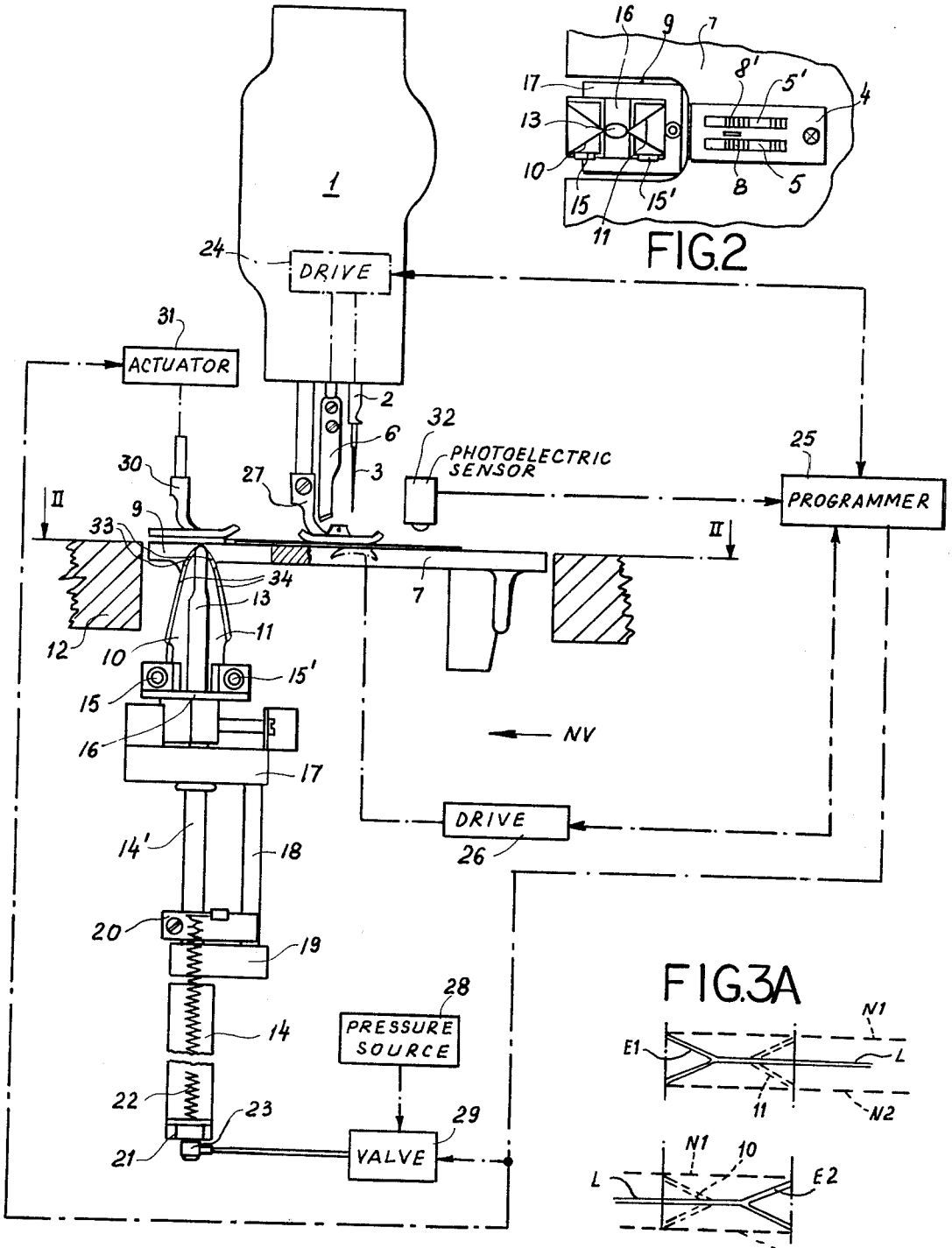
FIG.1
FIG.2
FIG.3A
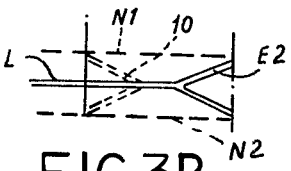
FIG.3B

ASSEMBLY FOR FORMING PIPED-EDGE OPENINGS IN A FABRIC WORKPIECE

FIELD OF THE INVENTION

My present invention relates to an apparatus or assembly for forming a piped-edge or bound opening in a fabric workpiece. More particularly, my present invention relates to an assembly including a sewing machine for stitching bound button holes or pocket openings, especially in outer garments such as jackets or trousers.

BACKGROUND OF THE INVENTION

It has become the practice in the garment industry to reinforce pocket openings in jackets and trousers with a binding strip of greater wear resistance than the fabric of the garment. Generally automatic feeding machines are used for prefolding the binding strip and positioning the same on a main workpiece ahead of a pair of sewing needles at a sewing machine. The workpiece and the strip are pushed together past the sewing needles and past a blade which cuts a longitudinal incision between parallel seams stitched by the needles. Downstream of the sewing station a pair of angled or angular blades is provided for cutting V-shaped incisions at the ends of the longitudinal incision. Such angular blades are commonly mounted on a complex positioning and actuating mechanism disposed below a work table supporting the sewing machine.

The state of the art is representatively illustrated and described in U.S. Pat. Nos. 3,747,545 and 3,814,037, issued July 24, 1973 and June 4, 1974, respectively. The angular cutters are generally separately mounted and separately actuatable.

OBJECT OF THE INVENTION

The object of my present invention is to provide at a sewing machine an assembly for forming piped-edge pocket openings, such assembly having a simple and reliable actuating mechanism.

SUMMARY OF THE INVENTION

An assembly or apparatus for forming a piped-edge opening in a workpiece comprises according to my present invention a work table, a sewing machine on the table for stitching a pair of parallel seams in the workpiece and in a reinforcing strip laid thereon, a blade mounted on the table and preferably on the sewing machine for cutting a slit in the workpiece and the strip between the two seams, a pair of angular cutters fixed with respect to one another and shiftably mounted on the table downstream of the sewing machine and the blade for cutting a pair of angular incisions in the workpiece and the strip at opposite ends of the slit, and a fabric spreader synchronized with the cutters for entering and widening the slit ends to enable first one and then the other of the cutters to traverse the slit upon a pair of consecutive upward strokes of the cutters, whereby the same alternate in severing the workpiece-and-strip combination. A transport device, such as the conventional feed dogs, is engageable with the workpiece and the strip to advance the same past the sewing needles, the blade and the cutters, while an actuator is connected to the cutters for vertically reciprocating the same to punch or cut the angular incisions in the fabric pieces. The cutters are V-shaped in horizontal cross-section and face in opposite directions, i.e. one cutter's vertex points in the direction of material transport and the other's vertex points back along the transport direction.

According to another feature of my present invention, the spreader is in the form of a mandrel, the cutters being mounted on on opposite sides of this mandrel. Preferably, the vertices of the cutters engage or are joined to the mandrel.

Pursuant to further features of my present invention, the actuator includes a pneumatic cylinder to which the cutters and the mandrel are attached, while a monitor or sensor is provided for detecting the leading and the trailing edge of the reinforcing strip upon motion thereof along the transport path. A programmer connected to the monitor and to the cylinder actuates the same at least partially in response to signals from the sensor.

An assembly according to my present invention has a minimum of moving parts, whereby reliability is increased and wear reduced. Accuracy and simplicity are combined in one apparatus.

BRIEF DESCRIPTION OF THE DRAWING

These and other features of my present invention will now be described in detail, reference being made to the accompanying drawing, in which:

FIG. 1 is a partially schematic and partially cross-sectional side view of a sewing-station assembly for forming a piped-edge or bound opening in a garment workpiece, showing a sewing machine with base plate and a pair of angular-incision cutters according to my present invention;

FIG. 2 is a partial top view of the base plate of FIG. 1, taken along line II—II therein;

FIGS. 3A and 3B are diagrammatic representations of opposite ends of a slit in a workpiece, showing angular incisions made by the cutters of FIGS. 1 and 2;

SPECIFIC DESCRIPTION

Figure 4:
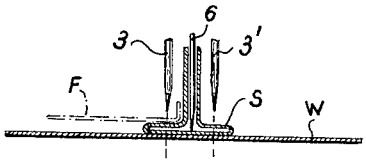
FIG. 4 is a cross-sectional view of a main workpiece and a prefolded reinforcing strip sewn thereon by double needles of the sewing machine of FIG. 1.

As illustrated in FIG. 1, an assembly for forming a piped-edge or bound opening such as a button hole or pocket opening in a jacket or trousers comprises a sewing machine 1 and a pair of angular cutters 10 and 11 (see FIG. 2). Sewing machine 1 has a drive 24 including clutches (not shown) mechanically, hydraulically, pneumatically or electromagnetically actuated under the control of a programmer 25 for vertically reciprocating a pair of needle bars 2 carrying respective sewing needles 3, 3' (see FIG. 4). Needles 3, 3' recurrently traverse respective apertures 5, 5' (FIG. 2) in a stitch plate 4 to cooperate with a rotary thread gripper (not shown) in forming a pair of parallel seams N1, N2 (FIGS. 3A, 3B, 5A, 5B) in a fabric workpiece W and a reinforcing or binding strip S laid thereon.

As best seen in FIG. 2, sewing machine 1 has a pair of feed dogs 8, 8' actuated by a conventional drive 26 under the control of programmer 25; dogs 8, 8' periodically traverse apertures 5, 5' vertically and longitudinally for advancing workpiece W and strip S along a transport path, indicated in FIG. 1 by an arrow NV, extending past needles 3, 3', a cutting blade 6 and a presser foot 27. Blade 6 is disposed between sewing needles 3, 3' and is connected to clutch drive 24 for reciprocating under the control of programmer 25 to sever fabric threads of workpiece W and strip S, whereby a longitudinal incision or slit L (FIGS. 3A, 3B, 5A, 5B) is formed substantially halfway between seams N1 and N2.

As illustrated in FIGS. 1 and 2, cutters 10 and 11 are removably clamped to a carrier 16 by means of respective fasteners including screws 15 and 15' and have V-shaped vertices engaging a guide mandrel or pin 13 at opposite sides thereof. The cutters are fixed with respect to one another and with respect to the mandrel.

Carrier 16 forms the head of a plunger 14' of a pneumatic cylinder 14 secured to work table 12 or sewing machine 1 by a pair of end brackets or braces 19 and 21. Plunger 14' passes through apertures in bracket 19 and in a stationary guide plate 17. This plate 17 and bracket 19 are rigidly connected by a guide rod 18.

A clasp is adjustably attached at one end to plunger 14' and slidably engages at an opposite end guide rod 18, this clasp or clip preferably being generally Y-shaped and receiving rod 18 in a pheripheral recess. Clip 20 serves to anchor one end of a restoring spring 22 hooked at an opposite end to bracket 21.

As shown in FIG. 1, cylinder 14 has an air inlet or port 23 connectable to a pressure source 28 or to the atmosphere via a valve 29 operated by programmer 25. Upon the depressurization of cylinder 14, restoring spring 22 returns plunger 14 to a retracted or withdrawn position (shown in FIG. 1). Upon the charging of cylinder 14 and the consequent upward stroke of plunger 14', angular cutters 10 and 11 traverse an aperture 9 in the base plate 7 of the sewing machine, thereby punching V-shaped or angular incisions E1 and E2 in workpiece W and strip S, as described more fully hereinafter with reference to FIGS. 3A, 3B, 5A, 5B. A clamp 30 is provided for pressing workpiece W and strip S to base plate 7 during punching or incision strokes of cutters 10 and 11; clamp 30 may be reciprocated in synchronism with cutters 10 and 11 by an actuator 31 in response to signals from programmer 25.

Upon the positioning of workpiece W and strip S on table 12 upstream of sewing needles 3, 3' and blade 6, the respective positions and cross-sections of the fabric pieces being illustrated in FIG. 4, programmer 25 emits signals to sewing-needle drive 24 and material-transport drive 26 to activate the same to advance workpiece W and strip S past the sewing station for stitching seams N1 and N2 and cutting slit L. As shown in FIG. 1, a photoelectric sensor 32 is mounted on work table 12 or on sewing machine 1 preferably upstream of the sewing station for detecting the passage first of a forward edge Z1 and subsequently of a rear edge Z2 of the reinforcing strip S. Upon receiving a signal from the sensor indicating the passage of the forward strip edge Z1, programmer 25 counts a predetermined number of stitches sewn by needles 3, 3' and then emits signals to valve 29 and to actuator 31, whereby cutters 10, 11 and clamp 30 respectively execute upward and downward strokes.

Figure 5A:
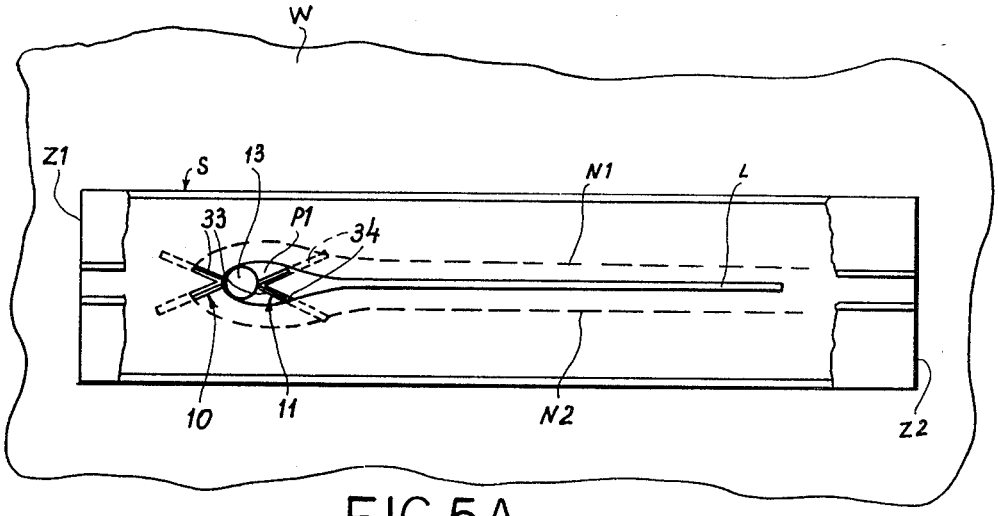
FIG. 5A is a partially broken-away top view of the workpiece and the reinforcing strip of FIG. 4, illustrating the operation of the cutters of FIGS. 1 and 2 to form a V-shaped incision at the leading end of a pocket or button-hole slit.
Figure 5B:
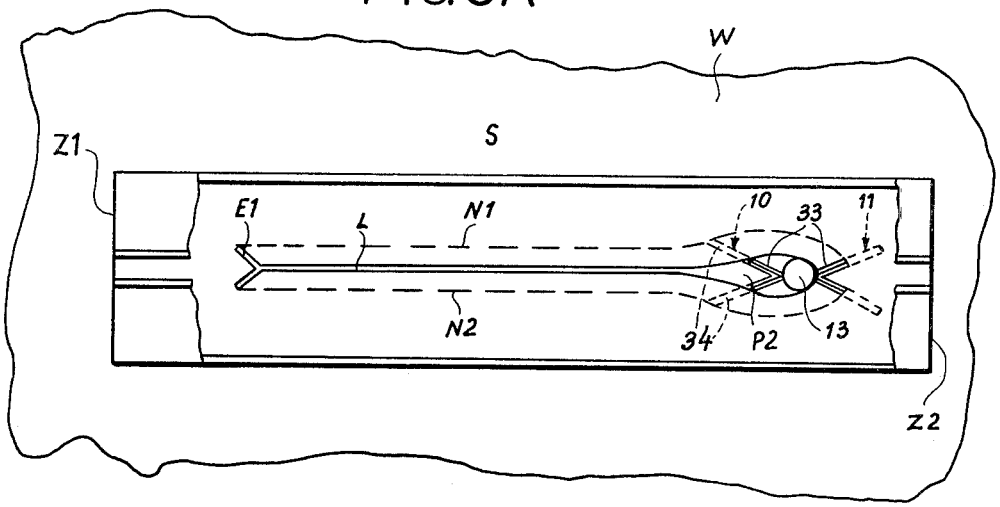
FIG. 5B is a view similar to FIG. 5A, illustrating the formation according to my present invention of a rear or trailing V-shaped incision.

As illustrated in FIGS. 1 and 5A, 5B, each cutter 10, 11 includes a pair of legs or shanks connected at a V-shaped vertex or junction, each shank having an upper sharpened or blade portion 33 of a relatively shallow angle of inclination with respect to the horizontal and a lower unsharpened guide portion 34 with a relatively large inclination angle. Upon the upward stroke of cutters 10, 11, mandrel 13 enters slit L at the forward end thereof and spreads the slit to form a widened portion P1, as shown in FIG. 5A, whereby the blade portions 33 of cutter 11 traverse the slit without severing any threads of fabrics W and S. In addition, mandrel 13 stretches the material of workpiece W and strip S forward of the front end of slit L, thereby facilitating the formation of V-shaped incision E1 by cutter 10, and corrects any small misalignment of the fabric pieces, thereby ensuring that the two shanks of the incision E1 extend from the forward end of slit L to respective forward ends of seams N1 and N2. These seam ends together with the rear ends of seams N1 and N2 will form the corners of the finished piped-edge pocket opening or button hole.

Upon the completion of an upward cutter stroke implementing the cutting of angular incision E1 (see FIGS. 3A and 5B), programmer 25 actuates valve 29 to connect port 23 to the atmosphere, plunger 14' consequently retracting under the restoring force of spring 22. Actuator 31 is then enabled to raise clamp 30. Drives 24 and 26, temporarily halted upon the charging of cylinder 14, are reactivated by programmer 25 to continue any unfinished stitching of seams N1 and N2 and cutting of slit L.

Upon receiving a signal from sensor 32 indicating the passage of rear strip edge Z2, programmer 25 counts a predetermined number of feed-dog reciprocations and then arrests drives 24 and 26 and actuates cutters 10, 11 and clamp 30. As illustrated in FIG. 5B, the top or apex of mandrel 13 enters the rear end of slit L to increase the separation of the slit sides and thereby form an elongated slit portion P2. This enlargement or widening of the slit prevents any slicing of workpiece W or strip S by the blade portions 33 of cutter 10. As heretofore described with respect to the forward angular incision E1, the fabrics of workpiece W and strip S to the rear of the hind end of slit L are aligned and stretched by mandrel 13 to facilitate the accurate formation of rear angular incision E2 (see FIG. 3B).

As indicated in dot-dash lines in FIG. 4, a pocket pouch F, or pocket flap, may be positioned proximate to strip S for being sewn thereto and to workpiece W.

Guide edges 34 of cutters 10 and 11 serve in part to further spread slit L during terminal portions of upward cutter strokes.

I claim:

1. An assembly for forming a piped-edge opening in a workpiece, comprising:

a work table;

sewing means including a sewing machine on said work table for stitching a pair of parallel seams in said workpiece and in a reinforcing strip laid thereon;

first severing means mounted on said table for cutting a slit in said workpiece and said strip between said seams;

transport means mounted on said table and engageable with said workpiece and said strip for advancing same past said sewing machine and said severing means;

second severing means mounted on said table downstream of said sewing machine and said first severing means along said path for cutting a pair of angular incisions in said workpiece and said strip at opposite ends of said slit, said second severing means including two angular cutters fixed with respect to one another and facing in opposite directions, said cutters being shiftably mounted on said table for vertical reciprocation;

actuating means connected to said second severing means for reciprocating said cutters; and spreading means synchronized with said cutters for entering and widening said slit at said ends to enable first one and then the other of said cutters to traverse said slit upon a pair of consecutive upward strokes of said cutters, whereby same alternate in severing said workpiece and said strip.

2. The assembly defined in claim 1 wherein said spreading means includes a mandrel and said cutters are mounted on opposite sides of said mandrel.

3. The assembly defined in claim 2 wherein said actuating means includes a pneumatic cylinder, said cutters and said mandrel being attached to a plunger of said cylinder.

4. The assembly defined in claim 2 or 3, further comprising monitor means for detecting a forward edge and a rear edge of said strip upon motion thereof along said path and programming means operatively connected to said monitor means and to said cylinder for actuating same at least partially in response to signals from said monitor means.

* * * * *